US005359306A

United States Patent [19]

Fasola et al.

[11] Patent Number: 5,359,306

[45] Date of Patent: Oct. 25, 1994

[54] ELECTROMAGNETIC DEVICE FOR CONTROLLING THE SUPPLY OF CURRENT TO THE ELECTRIC STARTER MOTOR OF AN INTERNAL COMBUSTION ENGINE

[75] Inventors: Giancarlo Fasola; Fabio Arpino; Giovanni Cerizza, all of Milan, Italy

[73] Assignee: Industrie Magneti Marelli S.p.A., Milan, Italy

[21] Appl. No.: 69,583

[22] Filed: Jun. 1, 1993

[30] Foreign Application Priority Data

Jun. 10, 1992 [IT] Italy ..... 92 A 000 498

[51] Int. Cl.[5] ..... H01H 67/02

[52] U.S. Cl. ..... 335/126; 335/131

[58] Field of Search ..... 335/126, 131

[56] References Cited

U.S. PATENT DOCUMENTS 5,142,924 9/1992 Fasola et al. ..... 335/131

FOREIGN PATENT DOCUMENTS 525601 6/1956 Belgium .
0324262A1 7/1989 European Pat. Off. .
0489697A1 6/1992 European Pat. Off. .
1104024 12/1956 Fed. Rep. of Germany .
1185703 7/1963 Fed. Rep. of Germany .

*Primary Examiner*—Lincoln Donovan
*Attorney, Agent, or Firm*—Edward D. Manzo

[57] ABSTRACT

The device comprises two fixed contacts, a movable assembly coupled to the central portion of a movable contact the free ends of which can cooperate with the said fixed contacts, and a control electromagnet comprising a solenoid and a movable core displaceable from an initial rest position to a final position in which it strikes a stop element carrying with it the movable assembly so as to bring the end of the movable contact against the fixed contacts before reaching the final position. The movable contact can flex resiliently like a beam under the effect of its engagement with the fixed contacts. When the core strikes the stop element, the fixed contacts oscillate about their normal working positions. The movable contact is made in such a way that, as the fixed contacts start to oscillate its free ends follow the movements of the fixed contacts, its acceleration in its own mode of vibration being greater than the acceleration of the fixed contacts and its amplitude of oscillation being greater than the amplitude of oscillation of the fixed contacts.

4 Claims, 2 Drawing Sheets

ELECTROMAGNETIC DEVICE FOR CONTROLLING THE SUPPLY OF CURRENT TO THE ELECTRIC STARTER MOTOR OF AN INTERNAL COMBUSTION ENGINE

DESCRIPTION

The present invention relates to an electromagnetic device for controlling the supply of current to the electric starter motor of an internal combustion engine.

More specifically, the subject of the invention is an electromagnetic device comprising

- a support element carrying two fixed contacts intended to be connected to a voltage source and to the electric starter motor respectively,
- a support structure fixed to the support element and including
- a stationary stop element,
- an assembly movable relative to the stop element and coupled to a central portion of a movable contact the free ends of which can cooperate with the fixed contacts to control the supply of current to the electric motor, and
- a control electromagnet comprising a stationary solenoid and an associated movable core displaceable by excitation of the solenoid from an initial rest position to a final position in which it strikes the stop element, the movable core carrying with it the movable assembly in such a way as to bring the ends of the movable contact into abutment with the fixed contacts before reaching the final position; the movable contact being able to flex like a resilient beam under the effect of its engagement with the fixed contacts.

In electromagnetic devices of this type it is observed that, when the movable core strikes the stop element, it also transmits a strong force to the support element which carries the fixed contacts. These latter are, in particular, caused to oscillate about their normal working positions, with very significant initial accelerations of the order of 4000 g. These accelerations cause the fixed contacts to separate from the ends of the movable contact. This effect, which translates into an increase in resistance and a corresponding fall in the voltage supplied to the electric starter motor, causes electric arcing between the movable contact and the fixed contacts which can compromise its durability and cause the so-called "sticking".

The object of the present invention is to provide an electromagnetic device of the aforesaid type which overcomes the problem described above.

This object is achieved according to present invention by means of an electromagnetic device of the type specified above, characterised in that the movable contact is made in such a way that, when the fixed contacts start to oscillate, the ends of the movable contact follow the movements of the fixed contacts with an acceleration in its own mode of vibration and an amplitude of oscillation being greater than those of the fixed contacts.

BRIEF DESCRIPTION OF THE DRAWINGS

Further characteristics and advantages of the invention will become apparent from the detailed description which follows, made with reference to the appended drawings, provided purely by way of non-limitative example, in which.

DESCRIPTION OF THE PREFERRED EMBODIMENT

Figure 1:
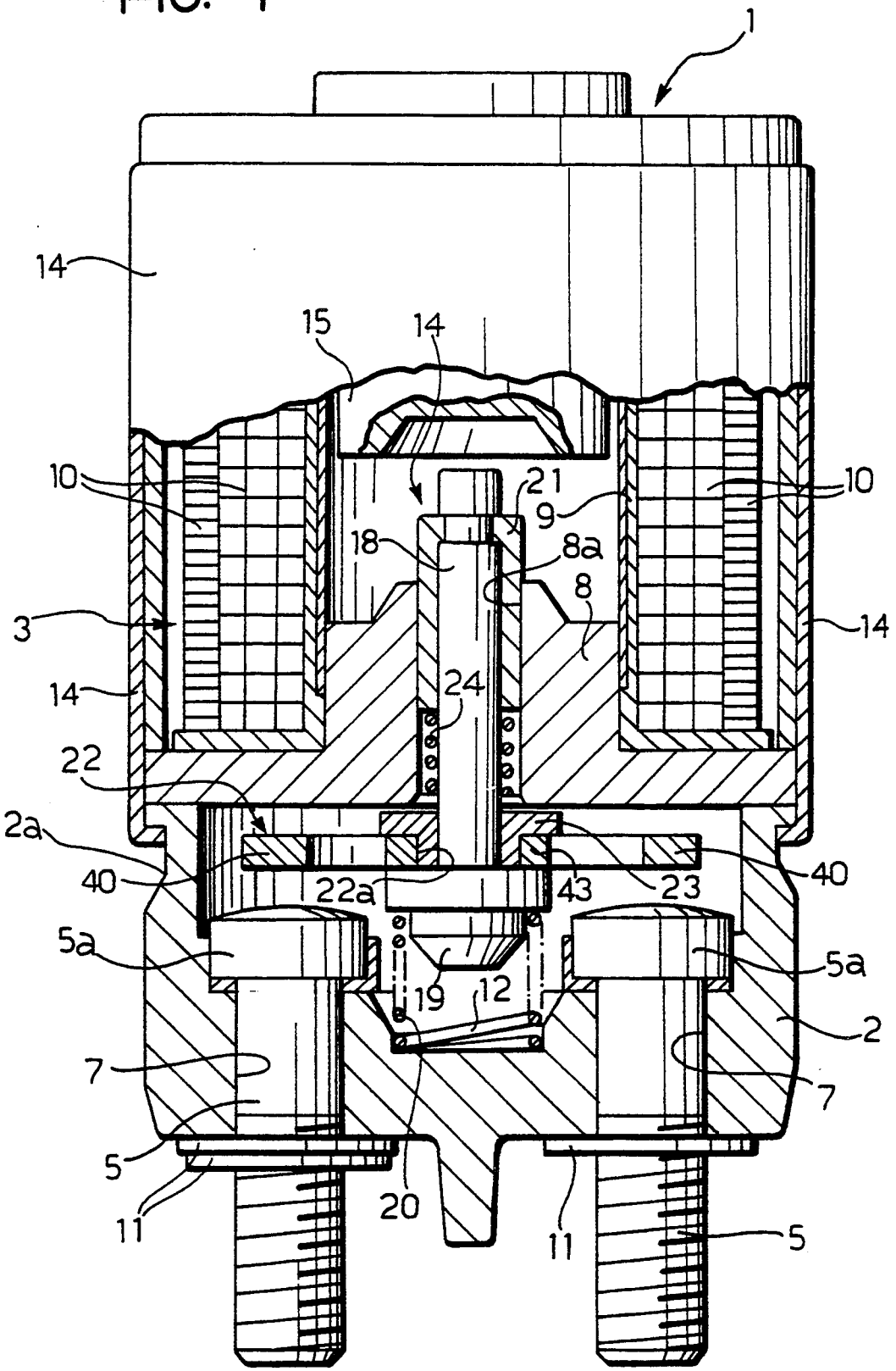
FIG. 1 is a partial axial section of an electromagnetic device according to the invention.

In FIG. 1 the reference numeral 1 generally indicates an electromagnetic device usable in particular for controlling the supply of current to the electric starter motor (not shown) of an internal combustion engine.

Electromoganetic device 1 comprises, in known manner, a substantially cup-shaped support element 2 having two apertures 7 in its bottom wall through which extend two screws 5 of electrically conductive material, preferably copper.

The screws 5 have respective heads 5*a* which bear against the bottom wall of the support element, 2 the screws 5 being fixed to this wall by washers 11 force-fitted on their respective threaded shanks which project from the support element 2.

The screws 5 serve as fixed contacts and are intended to be connected, one to a source of DC voltage such as the battery of a motor vehicle and the other to the electric starter motor of the internal combustion engine of the motor vehicle.

A tubular metal casing 14 is securely fixed to the support element 2 with its lower edge clenched in an outer annular recess 2*a* in the upper portion of the support element 2.

A control electromagnet 3 is mounted within the casing 14.

Control electromagnet 3 includes a stop and guide element 8 disposed in contact with the upper edge of the support element 2 and having an axial passage 8*a*.

Around the stop and guide element 8 is a tubular former 9 on which a control solenoid 10 is wound.

The movable core of the central electromagnet 3 is indicated as core 15. This core 15 is mounted so as to be translatable in the axial passage defined within the former 9.

The stop and guide element 8 also acts as the fixed armature, into which some of the lines of magnetic flux generated by excitation of the solenoid 10 extend.

A movable assembly generally indicated 17 is axially translatable in the axial passage 8*a* of the stop and guide element 8.

This assembly includes a rod 18 which has a head 19 at its end facing the support element 2.

A coil spring 20 is disposed in a recess 12 in the support element 2 between the bottom wall of this recess and the head 19 of the rod 18.

On the other end of the rod 18 is fixed a bush 21 guided for sliding movement in the passage 8a in the element 8.

A movable contact 22 of substantially rectangular shape is fitted between the bush 21 and the head 19 on the rod 18.

This movable contact 22 has a central seat 22*a* through which the rod 18 extends with the interposition of a packing element 23.

A rather rigid coil spring 24 is disposed around the rod 18 between the bush 21 and the packing element 23. This spring is precompressed and urges the movable contact 22 against the head 19 of the rod 18.

Figure 2:
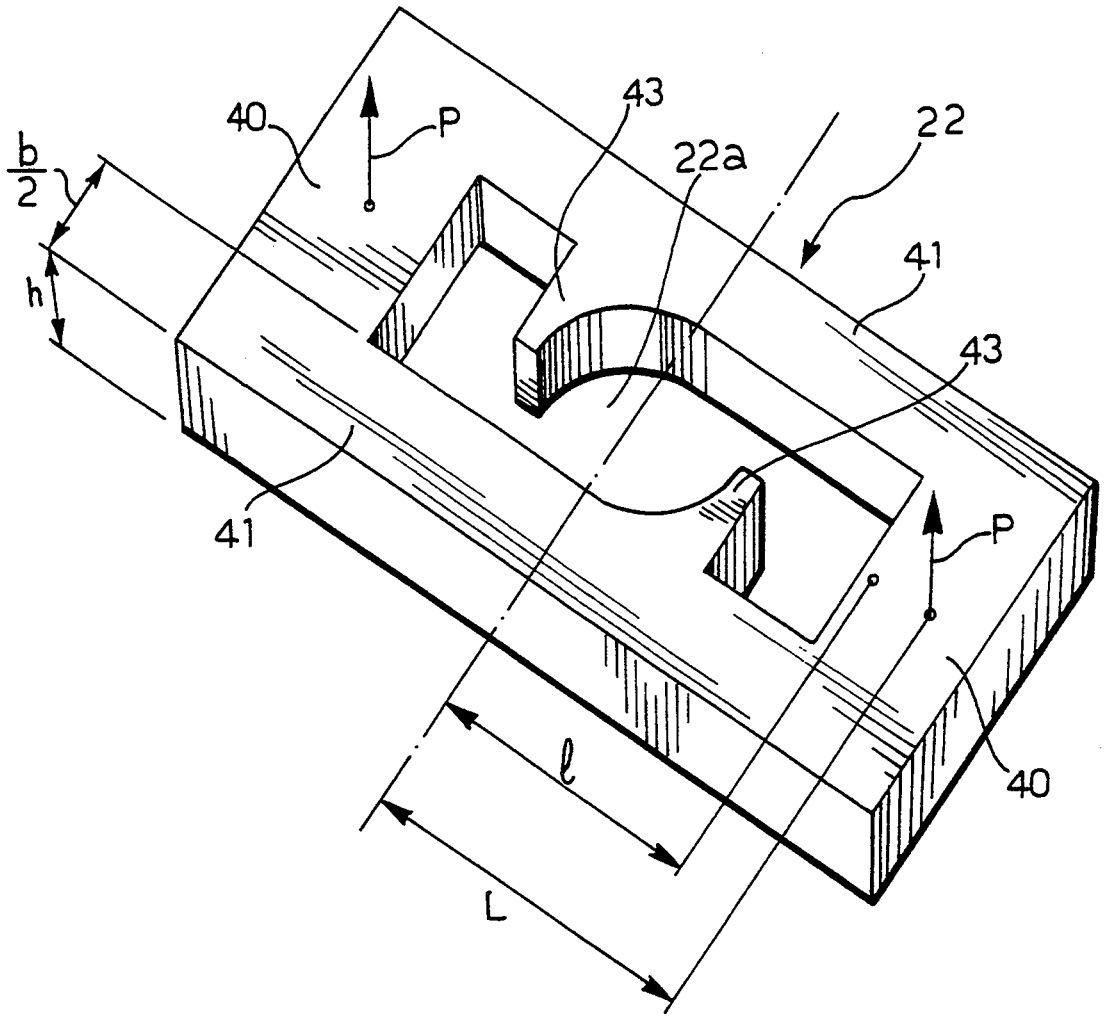
FIG. 2 is a perspective view of a movable contact of the electromagnetic device of FIG. 1.

In the embodiment illustrated by way of example in FIG. 2, the movable contact 22 is essentially in the shape of a rectangular frame, the shorter sides 40 of which face and are intended to engage the fixed contacts 5a.

From the facing internal faces of the longer sides 41 of the movable contact 22 extend respective projections or appendages 43 which together define a seat or passage 22a through which extends the rod 18 with its associated packing element 23.

As will be seen in FIG. 2, in the illustrated embodiment the projections or appendages 43 on the longer sides of the movable contact are formed in respective positions offset on opposite sides of the centre of the movable contact and their facing edges are shaped as circular arcs.

The movable contact described above can be cut from a sheet of copper and has a certain resilient flexibility. This movable contact member is, in particular, capable of flexing resiliently like a beam when its shorter sides 40 are brought to bear against the fixed contacts 5a in operation, as will become more clearly apparent below.

As for devices known in the prior art, on excitation, the control solenoid 10 causes the core 15 to move towards the movable assembly 17. The core 15 thus reaches the rod 18 of this assembly and urges it towards the fixed contacts 5a. After having brought the movable contact 22 into abutment with the fixed contacts 5a, the movable core 15 continues its travel towards the guide and stop element 8. Correspondingly, the rod 18 advances towards the bottom wall of the support element 2, sliding relative to the movable contact 22 which bears against the fixed contacts 5a, and compressing the coil spring 24 between the movable contact 22 and the bush 21.

The stroke of the movable core 15 ends when it reaches a final position in which it strikes the guide and stop element 8.

As a result of this impact, the support element 2 and the associated fixed contacts 5a oscillate about their normal working positions, with a rather high initial acceleration which can reach values of the order of 4000 g.

In this situation, the fixed contacts 5a would tend to separate from the ends 40 of the movable contact 22.

To avoid this problem, the movable contact 22 is formed, according to the invention, in such a way that, as the fixed contacts start to oscillate, its two free ends 40 are able to follow the movements of the fixed contacts with an acceleration in their natural mode of vibration, and an amplitude of oscillation, greater than those of the fixed contacts 5a.

If the amplitude of oscillation or displacement and the acceleration of the fixed contacts 5a are indicated s and a respectively, and supposing that, as a result of the impact of the core 15 on the element 8, these contacts are subject to an oscillation of non-damped type, then:

$$a=s\omega^2 \sin \omega t$$

in which t is time and $$\omega=2\pi f$$

is the angular frequency of the oscillation, f being the frequency.

This acceleration assumes a maximum value equal to $$a_{max}=s.\omega 2=s.(2\pi f)^2$$

The maximum acceleration $a_{max}$ (peak acceleration) and the frequency f are measurable experimentally.

According to the invention, the movable contact 22 must be dimensioned in such a way that its ends 40 can move with an acceleration $a_{1max}$ greater than the maximum acceleration $a_{max}$ of the fixed contacts:

$$a_{1max}>s.(2\pi f)^2=a_{max}.$$

The acceleration $a_1$ of the ends 40 depends on the natural frequency of vibration of the movable contact 22 and the initial condition of the movement, which corresponds to the flexure $s_1$ of the movable contact as a result of the thrust on it exerted by the spring 24:

$$a_1=s_1.(2\pi f_1)^2.\sin(2\pi f_1)t.$$

The maximum acceleration $a_{1max}$ is equal to:

$$a_{1max}=s_1.(2\pi f_1)^2$$

To avoid separation of the movable contact 22 from the fixed contacts 5a it is also necessary for the displacement of the fixed contacts 5a to be less than the displacement of the ends 40 of the movable contact 22 which, at most, can reach the value $s_1$ due to the static deflection.

If the thrust exerted on the movable contact 22 by the spring 24 is indicated 2P, a reaction of magnitude P (FIG. 2) is developed at the points of contact of this movable contact 22 with the fixed contacts 5a.

If the distance between the centre line of the movable contact 22 and the points at which it contacts the fixed contacts 5a is indicated L, the displacement $s_1$ is given by the known formula $$s_1 = \frac{P \times L^3}{3EJ}$$

in which E is the modulus of elasticity of the movable contact 22 and J is its moment of inertia.

The frequency of oscillation of the ends of the movable contact 22 is given by:

$$f_1=2\pi\omega_1=2\pi\sqrt{C_1/M_1}$$

in which $M_1$ is equal to half the mass of the movable contact 22 and $C_1$ is its rigidity, which is given by:

$$C_1 = \frac{bh^3E}{41^3}$$

in which (see FIG. 2) b is twice the width of the longer sides 41 of the movable contact 22, h is the thickness of the movable contact 22 and 1 is the distance between the centre line of the movable contact 22 and the point of application of the resultant of the infinitesimal forces of inertia dp acting on each infinitesimal portion of the beam following the oscillatory movement. In the case of a simple beam this distance is equal to about 41/5.

The formulae utilised are valid in the case of a contact of simple form corresponding to that of a simple beam.

In practice, these calculations are developed with the aid of the finite element method.

Once the maximum acceleration $a_{max}$ and the frequency f (or the angular frequency $\omega$) of the oscillatory movement of the fixed contacts 5a have been determined experimentally, the above expressions allow the movable contact 22 to be dimensioned in such a way that the following relations are satisfied:

$$s_1 > s \text{ and } a_1 > a.$$

If the movable contact 22 is made in such a way as to satisfy these conditions, then, as the fixed contacts 5*a* start to oscillate, its ends will in fact follow the fixed contacts without ever losing contact with them.

In this way the possibility of sparks or arcs being struck is avoided, as is the risk of damage to the fixed contacts and/or the movable contact.

Naturally, the principle of the invention remaining the same, the embodiments and details of construction can be widely varied with respect to what has been described and illustrated purely by way of non-limitative example, without by this departing from the ambit of the present invention.

We claim:

1. An electromagnetic device for controlling the supply of current to the electric starter motor of an internal combustion engine, comprising a support element carrying two fixed contacts intended to be connected to a voltage source and to the electric starter motor respectively, a support structure fixed to the said support element and including a stationary stop element, an assembly movable relative to the stop element and coupled to a central portion of a movable contact the free ends of which can cooperate with said fixed contacts to control the supply of current to the electric motor, a control electromagnet comprising a stationary solenoid and an associated movable core displaceable by excitation of the solenoid from an initial rest position to a final position in which it strikes the stop element, the movable core carrying with it the movable assembly in such a way as to bring the ends of the movable contact into abutment with the fixed contacts before reaching the final position; the movable contact being able to flex like a resilient beam under the effect of its engagement with the fixed contacts;

the arrangement being such that, when the core strikes the stop element the fixed contacts oscillate about their normal working positions; said movable contact being made in such a way that, when the fixed contacts start to oscillate, its free ends follow the movement of the fixed contacts, its acceleration in its own mode of vibration being greater than the acceleration of the fixed contacts and its amplitude of oscillation being greater than the amplitude of oscillation of the fixed contacts.

2. A device according to claim 1, in which the movable assembly comprises a rod having a first end facing and able to cooperate with the movable core, a second end in the form of a head facing the fixed contacts, and an intermediate portion on which the movable contact is slidably mounted; and resilient means associated with the said rod and operable to urge the movable contact against the said head;

the movable contact member having a rectangular-frame shape, the shorter sides of which are intended to engage the fixed contacts and the longer sides of which have projections or appendages on their respective internal edges which together define a seat or passage through which the intermediate portion of the said rod extends.

3. A device according to claim 2, wherein each longer side of the movable contact has a respective projection or appendage offset in a symmetrically opposite position from the projection or appendage of the other longer side with respect to the centre of the movable contact.

4. A device according to claim 3, in which the intermediate portion of the rod has a circular section and in which the facing edges of the said projections or appendages of the movable contact have corresponding circular arc shapes.

* * * * *